US006062316A

United States Patent [19]

Alhamad

[11] Patent Number: 6,062,316

[45] **Date of Patent: *May 16, 2000**

[54] COMPOSITIONS OF MATTER FOR STOPPING FIRES, EXPLOSIONS AND OXIDATIONS OF MATERIALS AND BUILD UP OF ELECTROSTATIC CHARGES

[76] Inventor: Shaikh Ghaleb Mohammad Yassin Alhamad, P.O. Box 31590, Riyadh, 11418, Saudi Arabia

[ * ] Notice: This patent is subject to a terminal disclaimer.

[21] Appl. No.: 09/103,687

[22] Filed: May 22, 1998

Related U.S. Application Data

[60] Division of application No. 08/470,642, Jun. 6, 1995, Pat. No. 5,816,332, which is a continuation-in-part of application No. 08/414,106, Mar. 31, 1995, abandoned, which is a continuation-in-part of application No. 07/806,901, Dec. 12, 1991, Pat. No. 5,402,852, which is a division of application No. 07/674,277, Mar. 19, 1991, Pat. No. 5,097,907, which is a division of application No. 07/417,696, Oct. 5, 1989, Pat. No. 5,001,017, which is a division of application No. 07/280,317, Dec. 6, 1988, abandoned.

[51] Int. Cl.[7] ..... A62C 2/00; A62C 3/07

[52] U.S. Cl. ..... 169/45; 169/62; 169/66; 169/48; 220/88.1; 220/450; 29/6.1

[58] Field of Search ..... 169/45, 46, 48, 169/49, 50, 62, 66; 220/4.14, 88.1, 450; 29/6.1

[56] References Cited

U.S. PATENT DOCUMENTS

| | | | |
|---|---|---|---|
| 4,405,076 | 9/1983 | Lines, Jr. et al. | 428/35 X |
| 4,958,554 | 9/1990 | Spaeth | 169/48 X |
| 5,058,346 | 10/1991 | Spaeth | 52/317 |
| 5,088,170 | 2/1992 | Spath | 29/6.1 |
| 5,247,822 | 9/1993 | Spath | 29/6.1 X |

FOREIGN PATENT DOCUMENTS

| | | |
|---|---|---|
| 256239 | 2/1988 | European Pat. Off. . |
| 2028129 | 3/1980 | United Kingdom . |

*Primary Examiner*—Andreas Kashnikow
*Assistant Examiner*—Steven J. Ganey
*Attorney, Agent, or Firm*—Charles E. Cates; Frank T. Barber

[57] ABSTRACT

An expandable metal product for use in extinguishing fires and in the prevention of or protection against explosions. The product is a continuous sheet of material having discontinuous slits in spaced apart lines parallel to each other but transverse to the longitudinal dimension of the sheet. The invention is also directed to the expanded form of the product, either in sheets which may be used for preventing fires or explosion or in the form of shaped ellipsoids for use in a passive inerting system for fuel tanks, as flame arresters, as anti-explosion barriers, and as shields against mechanical impact.

10 Claims, 3 Drawing Sheets

FIG. 3A
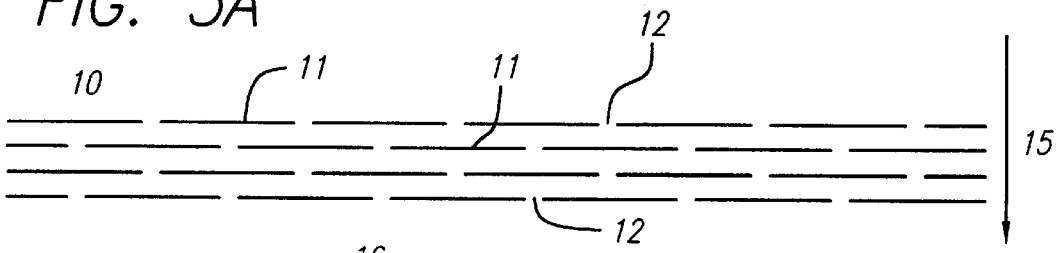
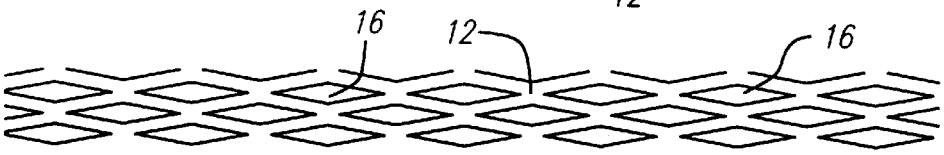
FIG. 3B
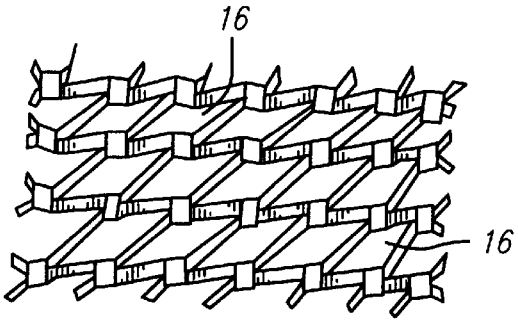
FIG. 3C
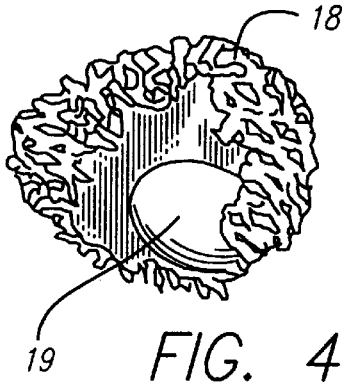
FIG. 4
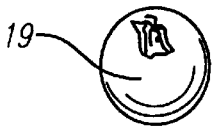
FIG. 5
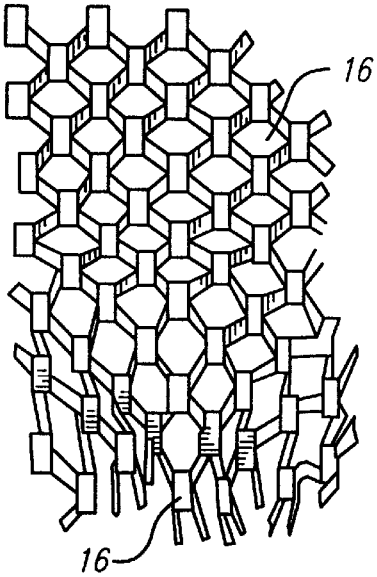
FIG. 3E
FIG. 3D
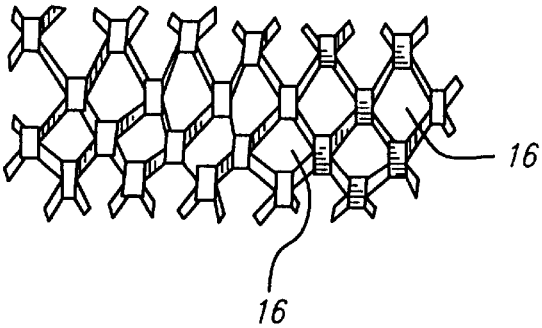

COMPOSITIONS OF MATTER FOR STOPPING FIRES, EXPLOSIONS AND OXIDATIONS OF MATERIALS AND BUILD UP OF ELECTROSTATIC CHARGES

This application is a division of U.S. application Ser. No. 08/470,642 filed on Jun. 6, 1995, now U.S. Pat. No. 5,816, 332 which is a continuation-in-part of U.S. application Ser. No. 08/414,106, filed Mar. 31, 1995, now abandoned, which is a continuation-in-part of application Ser. No. 07/806,901, filed Dec. 12, 1991 (now U.S. Pat. No. 5,402,852), which is a division of U.S. application Ser. No. 07/674,277, filed Mar. 19, 1991, now U.S. Pat. No. 5,097,907, which is a division of U.S. application Ser. No. 07/417,696, filed Oct. 5, 1989, now U.S. Pat. No. 5,001,017, which is a division of U.S. application Ser. No. 07/280,317, filed Dec. 6, 1988, now abandoned.

BACKGROUND OF THE INVENTION

The present invention relates to a unique form of expandable metal foil and to expanded nets made therefrom. The invention also relates to methods and apparatus for producing the said products, and to uses thereof, particularly in the extinguishing of fires, the prevention of explosions, and the protection against explosions and mechanical impact.

Surface fires, such as grassland and forest fires, as well as fires on the surface of water and on the surface of fuels in fuel tanks, are a continuing threat to life and property throughout the world. Over the years, numerous methods for combating such fires have been developed. The use of water, foams, chemicals and other quenching materials are well known.

It is also known to use blankets, mats, nets and other sheet-like materials to smother surface fires. However, these are heavy, bulky materials, and their use in widespread surface fires extending over thousands of acres of land or water, are subject to obvious limitations. Firefighting methods today are still limited to the steps of containing the fire as much as possible until it burns out or until changing weather conditions no longer support the burning. There is a need for a more efficient, inexpensive means for extinguishing fires which extend over wide surface areas.

There is also a need for more effective ways of preventing explosions in containers for fuels or other explosive substances. Containers such as fuel depots, liquid petroleum gas tanks, airplanes, ships, transport tankers, pipelines, and the like, are at risk from explosion caused by overheating, static electricity build up, mechanical impacts, etc. In addition to precautionary measures such as avoiding the above causes, a more recent approach to the problem has involved placing in the container a quantity of filling material in the form of a honeycomb shaped metal net—either in sheets or crumpled into balls. The theory of such approach is that the metal net promotes heat conduction and avoids static electricity build up, and thus reduces the risk of explosion. Although the approach has merit, there is nevertheless a substantial need for improvement, mainly because of deficiencies in the physical characteristics of the metal nets and balls, and also because of inefficiencies in the methods and apparatuses for producing such materials.

In the general area of fire-safety, there is also a need for improved products useful as flame arresters, anti-explosion barriers, and the like.

It is an object of the present invention to provide a product which is substantially more effective than known products, not only in the extinguishing of surface fires but also in the prevention of explosions in fuel tanks and the like, and in filling the other needs referred to above.

It is a further object of the invention to provide a fire extinguishing product which can be transported to the site of a surface fire in compact, semi-manufactured form and then stretched to its fully manufactured form as it is applied to the surface of the fire over an extended area.

It is another object of the invention to provide a product for filling into containers for fuel and other explosive materials to provide a highly superior anti-explosive protection.

Other objects and advantages will become apparent as the specification proceeds.

SUMMARY OF THE INVENTION

This invention is based on the development of a new form of an expandable slit metal foil which may be stretched into a three-dimensional metal net having unique properties. The expanded metal foil is useful in extinguishing surface fires and also in the prevention of explosions in fuel containers and the like. It is also useful for other purposes, which will be explained hereinafter.

In one of its forms, the product of the invention is an expandable metal product comprising a continuous sheet of metal foil having discontinuous slits in spaced apart lines parallel to each other but transverse to the longitudinal dimension of said sheet. When said continuous sheet is stretched longitudinally, it is transformed into a three-dimensional metal net, and when said net is laid over a surface fire the fire is smothered and thus extinguished.

The fire extinguishing capability of the metal net is based on the phenomenon that flame at the surface of a burning material cannot pass upwardly through the pores or eyes of the metal net. In a normal fire, the heat of the burning causes material at the surface of the fuel to vaporize and mix with the oxygen in the atmosphere above it to produce a flammable mixture. If the metal net of the present invention is interposed between the surface of the burning material and the atmosphere, the heat conductivity of the metal net reduces the heat of the fire and thus reduces the amount of vapor being produced. The net also prevents the flame at the surface of the burning material from reaching the flammable mixture of vapor and atmosphere above the fire, and for these two reasons the conditions for continued burning are removed and the fire is extinguished.

The expandable metal product of the present invention provides a significant advantage in the fighting of fires covering a large surface area. In producing the expandable product, rolls of continuous metal foil are passed through banks of slitting knives to provide lines of discontinuous slits which are parallel to each other but transverse to the longitudinal dimension of the continuous sheet. The slitted sheet is then, in the same process, and without stretching, collected on a roll, ready for transportation to the site of a fire. In their unstretched form, the rolls are very compact, and large numbers of them can be transported by aircraft or other means to the location of a fire. At the fire, the metal foil is unrolled and stretched as it is applied to the surface of the fire. The stretching of the expandable product increases the surface area by approximately a tenfold factor. For example, if a roll of this material in its unstretched form is 44 cm wide and 500 m long, it will cover 220 square meters in its unstretched form, but this will be increased to 2,000 square meters in its stretched form. It will thus be seen that a substantial advantage is gained in terms of transporting the raw material in compact lightweight form and then transforming it by stretching to cover large areas of burning surface at the site of the fire.

In a specific embodiment of the invention, the rolls of slitted foil in the unstretched form can be carried in airplanes or helicopters over a burning area, and weights can be applied to the ends of the sheets, such that, as the weights fall toward the burning area, the foil unrolls and is stretched as it unrolls, thus covering the greatly expanded area of the stretched metal net.

It is a feature of the invention that, in the manufacture of the expandable metal foil, the transverse slit lines are made to extend to the longitudinal edges of the foil sheets, thus eliminating unslit longitudinal margins which might resist longitudinal stretching of the slit sheet when subjected to longitudinal tension. This feature enables the rolls of expandable metal foil to be stretched into metal nets as they are unrolled at the sites of fires, thus providing the very substantial gain in area of coverage, as described above.

In another of its forms, the metal net of the present invention is formed into small ellipsoid shapes which, by themselves or in combination with large sheets of expanded metal net, are useful not only for extinguishing surface fires but also for filling containers of fuel to prevent explosions therein. If the ellipsoids are to be used on the surface of water or other liquid, they are provided with floatable cores. In the practice of one embodiment of the invention, such ellipsoids are placed on the surface of the liquid fuel in a fuel tank and provide a floating surface layer on said liquid. The ellipsoid shape enables the units to nestle together on the surface, eliminating vacant spaces between them, thus providing a continuous surface cover with no gaps through which flame from the liquid can upwardly escape. In another embodiment, the ellipsoids are used to completely fill large or small containers of fuel, for the purpose of preventing explosion of the fuel; and in this arrangement also, the ability of the ellipsoids to nestle together provides a superior gap-free configuration. In this respect, the ellipsoidal units of the present invention are superior to metal nets which are crunched into the shape of spheres, since a layer of floating spheres inevitably leaves gaps or spaces between the spheres, through which flame or heat from the liquid fuel can escape upwardly.

In the practice of another embodiment of the invention, the above-described ellipsoids with floatable cores are distributed over a fire burning on the surface of water, and then sheets of the expanded metal net of the present invention are laid in place on top of the floatable ellipsoids, thus preventing the sheets of expanded metal net from sinking below the surface. In the practice of a further embodiment, the above-described ellipsoids are distributed in large numbers on the surface of land fires, and the ability of the ellipsoids to nestle together with each other provides a continuous layer of metal net for smothering the fires, similar to the manner in which the sheets of expanded metal net operate.

In a further embodiment of the invention, when the expanded sheet is produced with a particular slit pattern, it may be formed into porous bodies which possess internal surface area and porosity characteristics enabling them to serve in additional capacities, such as flame arresters, explosion barriers, and barriers for protecting against mechanical impact.

BRIEF DESCRIPTION OF THE DRAWINGS

The objects, features and advantages of the invention will be apparent to those skilled in the art from the following detailed description, taken together with the accompanying drawings, in which:

FIGS. 3A through 3E are top views of the expandable metal product of the present invention, showing the change in configuration as the slitted sheet is pulled to open up the expanded metal net product.

FIG. 4 is a perspective view showing the ellipsoid form made from the expanded metal net of the present invention.

FIG. 5 is a perspective view of a hollow floatable ball which may be inserted on the interior of the ellipsoid.

DETAILED DESCRIPTION OF THE INVENTION

The Product and Its Uses

Figure 2:
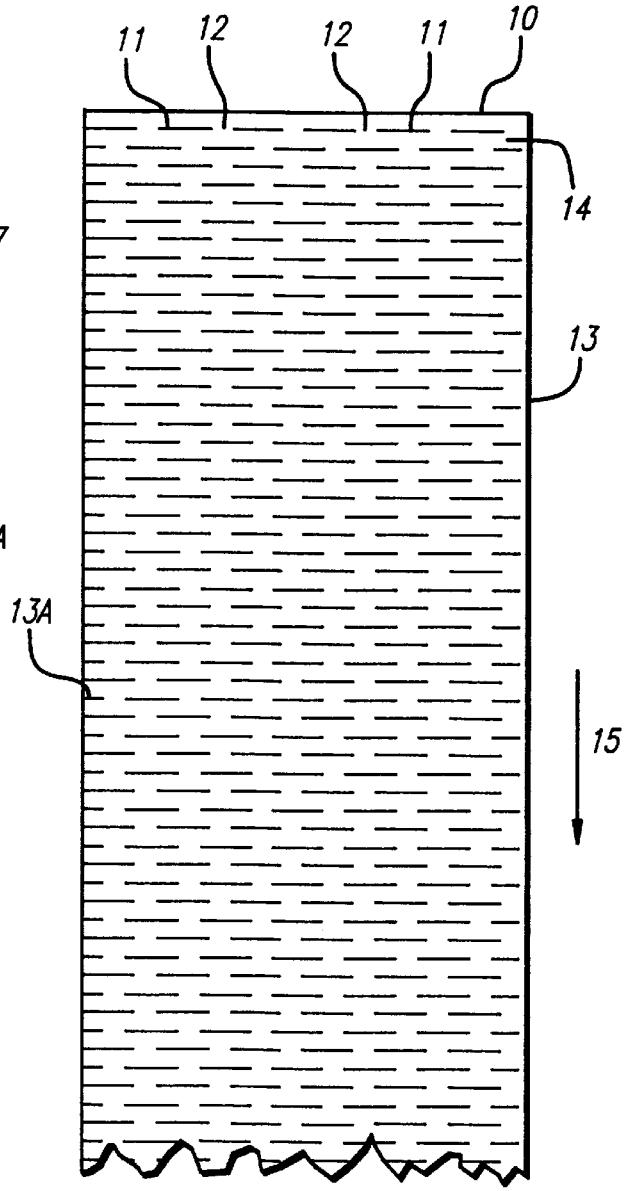
FIG. 2 is a top view of the expandable metal foil of the present invention, showing the pattern of transverse slits and the absence of margins.

Referring to the drawings, the expandable metal product of the present invention is exemplified by the continuous sheet of metal foil 10 shown in FIG. 2. As shown, the sheet of metal foil 10 is a small segment of a much longer sheet which normally is gathered in rolls containing a single sheet as long as 500 meters, or more. The width of the sheet 10 may be chosen from any number of practical dimensions. Widths in the range from 11 to 55 cm are preferred.

As noted, sheet 10 is provided with discontinuous slits 11 in spaced apart lines which are parallel to each other but transverse to the longitudinal dimension of the sheet 10. The slits 11 in each line are separated by unslit segments or gaps 12, and it will be noted that the slits 11 in each line are offset from the slits 11 in adjacent lines. Similarly, the gaps 12 in each line are offset from the gaps 12 in adjacent lines. The apparatus and method for producing the slitted metal foil 10 of the present invention are described in detail in U.S. Pat. No. 5,095,597, dated Mar. 17, 1992 and U.S. Pat. No. 5,142,735, dated Sep. 1, 1992.

It is a feature of the invention that the slits 11 extend to and intercept the longitudinal edges 13 of sheet 10, so that there are no unslit margins in the product. Although normally the slits in each line will intercept the edges 13, an arrangement in which only alternate lines of slits intercept the edges is also within the purview of the invention.

The thickness of the sheet material used to produce the products of the present invention should be in the range between 0.020 and 0.1 mm. The length of each slit 11 is in the range between 0.8 and 2.5 cm, and the unslit sections or gaps 12 between each slit are in the range between 1 to 6 mm long. It is preferred that in any sheet, the dimensions of all the slits be uniform, as well as the dimensions of all the gaps, although practical variations of this are also within the spirit of the invention. As a specific example, a sheet having gaps 2 mm long between slits 15 mm long would be a useful combination. Other examples include sheets with gaps 2 mm long between slits 17 mm long; gaps 3 mm long between slits 17 mm long; gaps 3 mm long between slits 20 mm long; gaps 4 mm long between slits 20 mm long; and so on. The distance 14 separating lines of slits may be varied, depending on the thickness desired for the resulting expanded metal net and the porosity and specific internal surface area desired therein. The distance 14 is ordinarily in the range between 1 and 5 mm.

For many of the uses contemplated for the product of the present invention, the kind of metal used in the slitted metal foil may be selected from a wide number of metals or alloys which may be produced in the form of a thin foil. However, for firefighting purposes, a significant part of the invention is based on the discovery that expanded metal nets made from alloys of magnesium with certain other compatible substances have the unique ability to extinguish burning fires as well as prevent the burning or explosion of combustible materials. More specifically, in this embodiment of the invention, it is especially useful to use an alloy of magnesium with substances such as aluminum, copper, zirconium, zinc, strontium, Rn(electron), silicon, titanium, iron, manganese, chromium, and combinations thereof. Alloys such as the above have the valuable characteristics of not only being lightweight, strong, elastic, heat-conductive, etc., but also the important characteristic of being nonflammable. A particularly useful combination is the alloy of magnesium with aluminum and copper. Another preferred combination is the alloy of magnesium with zirconium and strontium. The invention is illustrated in a specific example by an alloy comprising 0.25% Si, 0.3% Fe, 0.01% Cu, 0.01% Mn, 10% Al, 0.1% Zn, 0.08–0.1% Ti, and the remainder Mg. Such a product possesses tensile strength of 300 N/mm, proof stress of 200 n/mm, elongation of 10%, and Brinell hardness of (5/250-30). The magnesium alloy used in the invention should contain at least 0.5% by weight of magnesium.

In addition to the magnesium alloys referred to above, other materials may be used in the practice of the invention. Thus, for certain uses, it is possible to use foils made of aluminum, steel, copper, manganese, zinc, chrome, and alloys thereof. Aluminum and aluminum alloys are especially suited for certain applications. For example, the porous honeycomb network body of the present invention has been found useful in countering laser and radar beam attacks by scrambling and diffusing the focused beams, and for this use aluminum is a particularly suited material in view of its special absorptivity, thermal conductivity, and unique oxidation cycle properties.

The metals and alloys referred to above may also be alloyed or combined with non-metal components such as carbon. Thus, the objects of the invention can be achieved with materials such as aluminum/carbon alloys, magnesium/carbon alloys, and the like. A typical useful alloy of this nature comprises either an alloy of aluminum, or magnesium, or steel, or copper, or manganese, or zinc, or chrome, containing from 0.01 to 0.03 carbon.

For certain uses, the product of the present invention may be combined with other materials. For example, if the expandable metal foil is coated with an alkaline bichromate, the resulting expanded metal net acts as a corrosion inhibitor, since the bichromate acts to remove water from fuels and their containers. Further, if the metal foil is combined with oleates or similar compounds, the fire extinguishing capability of the expanded net is enhanced, since the oleate emits a dense vapor which covers the burning material and assists in the smothering of the flame.

When the slitted metal foil product of the present invention, as shown in FIG. 2, is stretched by subjecting it to longitudinal tension, it is converted into an expanded metal prismatic net. In the stretching procedure, the horizontal surfaces of the foil are raised to a vertical position, taking on a honeycomb-like structure. This conversion is shown in FIGS. 3A through 3E of the drawings. The expandable metal product 10 is shown in FIG. 3A prior to stretching. When longitudinal tension is applied in the direction of the arrow 15, the slits 11 begin to open, and the product assumes the appearance shown in FIG. 3B. The application of more tension causes a greater opening of the slits, and the product expands into the honeycomb-like, prismatic form shown in FIG. 3C. When even further tension is applied, the configuration becomes as in FIG. 3D, and finally when the greatest pulling force is applied, the expanded metal net appears as in FIG. 3E.

It will be noted that, as the tension increases from stage to stage, the slitted metal foil increases in area. The slits 11 are converted into eyes 16, and the sizes of the eyes 16 reach their maximum when stretched to the square configuration shown in FIG. 3C. Correspondingly, the area of the expanded net reaches its maximum at this point. Further stretching begins to reduce the size of the eyes, and FIG. 3E illustrates the return to eyes of the smallest dimensions. Thus, by controlling the extent of stretching, it is possible to produce an expanded metal prismatic net structure having the desired shape and size of eyes, and the desired expansion in area, depending on the use intended. The conversion illustrated in FIGS. 3A through 3E is also accompanied by an increase in thickness of the product, since the spaces 14 between slit lines assume a thickness dimension as the eyes open.

The increase in area when a slitted metal foil is stretched into an expanded foil prismatic net can be controlled not only by the extent to which the metal foil is stretched but also by the dimensions of the slits 11, the gaps 12 between slits, and the spaces 14 between lines of slits. For example, if a 250 cm sheet of foil is provided with transverse slits 2 cm in length with gaps of 2 mm between each slit, and a space of 1 mm between each line of slits, the foil sheet can be stretched to an average area of 2,272 square centimeters, with the thickness of the net being 2 mm (i.e., twice the value of the space 14 between each line of slits). If the spaces 14 between each line of slits are increased to 2 mm, the foil sheet can be stretched to an average area of only 1,136 square centimeters, but with a thickness of 4 mm. Thus, if the objective is to produce an expanded metal net having the maximum in area (as is desired in extinguishing surface fires), the preferred procedure is to keep the distance between lines of slits as small as possible while at the same time controlling the stretching of the sheet to produce the maximum size eyes, as in FIG. 3C. If greater thickness of the net is preferred, and area is not as important, as in the case of producing formed ellipsoids from the net, or in producing a material with high internal surface area, or in manufacturing some of the construction or insulation materials to be described hereinafter, then the distance 14 between lines of slits may be substantially increased, to a dimension, for example between 2 to 5 mm. The formula for calculating the increase in area as described above is:

$$\text{Area}=\text{Unstretched Area}\times[(a-b)/2c]\times[(a+b)/4]$$

Where:

a=length of slit 11 b=length of gap 12 c=distance 14 between lines of slits

By controlling the extent of stretching, as well as the dimensions of the slits 11 and the gaps 12 between slits, and by controlling the spaces 14 between lines of slits to within the range of 2 to 5 mm, it is possible to take advantage of the strength, hardness and other properties of some of the alloy foils to produce expanded nets which may be formed into products having exceptionally high specific internal surface areas (e.g., in the range of 250 to 325 $ft^2$ per $ft^3$) and above; exceptionally high porosity (e.g., in the range of 80 to 99%); and a volume resistivity of <50 ohm-m. These characteristics make the expanded metal net particularly useful in the production of flame arresters and anti-explosion units, as will be explained in greater detail hereinafter.

Figure 1:
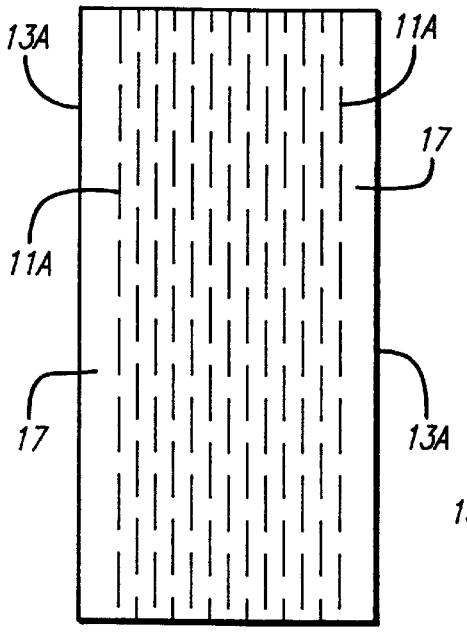
FIG. 1 PRIOR ART
FIG. 1 is a top view of a sheet of expandable metal foil made in accordance with prior art procedures, showing the pattern of longitudinal slits, as well as the margins along the edges of the sheet.

It is a feature of the invention that the lines of slits in the expandable metal foil are cut transverse to the longitudinal dimension of the long continuous sheet of foil. It is also a feature that the transverse slit lines extend to the longitudinal edges of the foil sheet, thus eliminating any unslit longitudinal margins. In the combination of these two features, the expandable metal foil of the present invention is different from expandable foil products which have been favored in the recent past. These distinctions can be understood by comparing the structures shown in FIGS. 1 and 2. FIG. 1 illustrates the configuration of slits in expandable metal foils as produced by prior art methods. It will be noted that the lines of slits 11A run parallel to the longitudinal edges 13A of the sheet of metal foil. It will also be noted, as shown in Schrenk U.S. Pat. No. 4,621,397, that substantial longitudinal margins 17 are left unslit. This is contrasted with the arrangement of the present invention, as shown in FIG. 2, wherein the lines of slits 11 run perpendicular to the longitudinal edges 13 of the continuous sheet, and the lines of slits 11 intercept the edges 13 so that there are no unslit margins.

The prior art product shown in FIG. 1 is made by slitting with banks of disc knives mounted at small intervals on a cylinder, with e.g., 1 mm between discs. The use of disc knives permits the slits 11A to be made only parallel to the longitudinal edges 13A of the continuous sheet. That is, the disc knife cylinder must have a horizontal axle which is mounted transverse to the longitudinal dimension of the continuous sheet being fed into the knives, and thus the knives produce slits which are parallel to the longitudinal dimension. It has been found that disc knives provide a less than satisfactory means for producing slits in rolls of metal foil, since it is difficult to prevent left and right slippage of the foil as it passes under the knives, especially if dust or metal pits are present. As a result, the slitting is imperfect, and expansion into appropriate metal nets is hampered. For this reason, it has not been possible to process sheets of foil more than about 15 cm in width.

A further disadvantage of the prior art procedure is that, since the slits 11A run parallel to the longitudinal edges 13A, the only way to stretch the foil into expanded form is to grasp the foil along the entire lengths of both longitudinal edges 13A and pull in a direction transverse to the longitudinal dimension of the sheet of foil. This has required that substantial unslit margins 17 be left along both longitudinal edges of the entire length of the sheet, so that the jaws of the longitudinal tensioning members have unslit sections of the sheet to grasp at each edge. The unslit margins 17 have generally been from 1 to 1.5 cm wide, and since the slit foil sheets which can be produced with disc knives can be no wider than about 15 cm, it will be understood that as much as 20% of the foil remains in unslit form. For all practical purposes, this is wastage, since the unslit portions cannot be used to expand the area of the resulting expanded net, and in fact the margins contribute only to an undesired addition of weight in the resulting net.

Further, continuous rolls of slit foil in which the slits run parallel to the longitudinal dimension of the foil sheet, as in the prior art illustrated in FIG. 1, cannot be stretched by pulling longitudinally. Thus, they are not capable of one of the important functions of the present invention—namely, transforming them into their expanded form while allowing them to unroll from an aircraft positioned above a fire. In the present invention, large area surface fires can be extinguished by a procedure which is enabled for the first time by the unique structure of the expandable metal foil product of the present invention. In this procedure, multiple rolls of the expandable metal foil are transported in an aircraft to a position above the fire. The expandable metal foil at this stage is in a semi-manufactured condition, in that the foil has been provided with slits but then rolled back up before stretching to the expanded form. In this semi-manufactured stage, the rolls of foil are very compact and occupy a minimum of space in the aircraft. As the next step, weights are attached to the free ends of the slitted foil on the rolls, and the weights are dropped out of the aircraft toward the surface fire. As the weights move downward, the effect of gravity unrolls the continuous sheets of slitted foil from the rolls while at the same time pulling and stretching the slitted foil to transform it into expanded metal nets of maximum area. In this manner, metal nets hundreds of meters long cover the fire immediately, causing the fire to be extinguished. The unique construction of the expandable metal net of the present invention, therefore, makes it possible to carry extremely compact rolls of the material to the scene of the fire and then, in a single step, apply it to the surface of the fire over an area ten times greater than the original area of the sheet. Prior art products, with slits running in the opposite direction, and with unslit longitudinal margins, were incapable of this.

Figure 6:
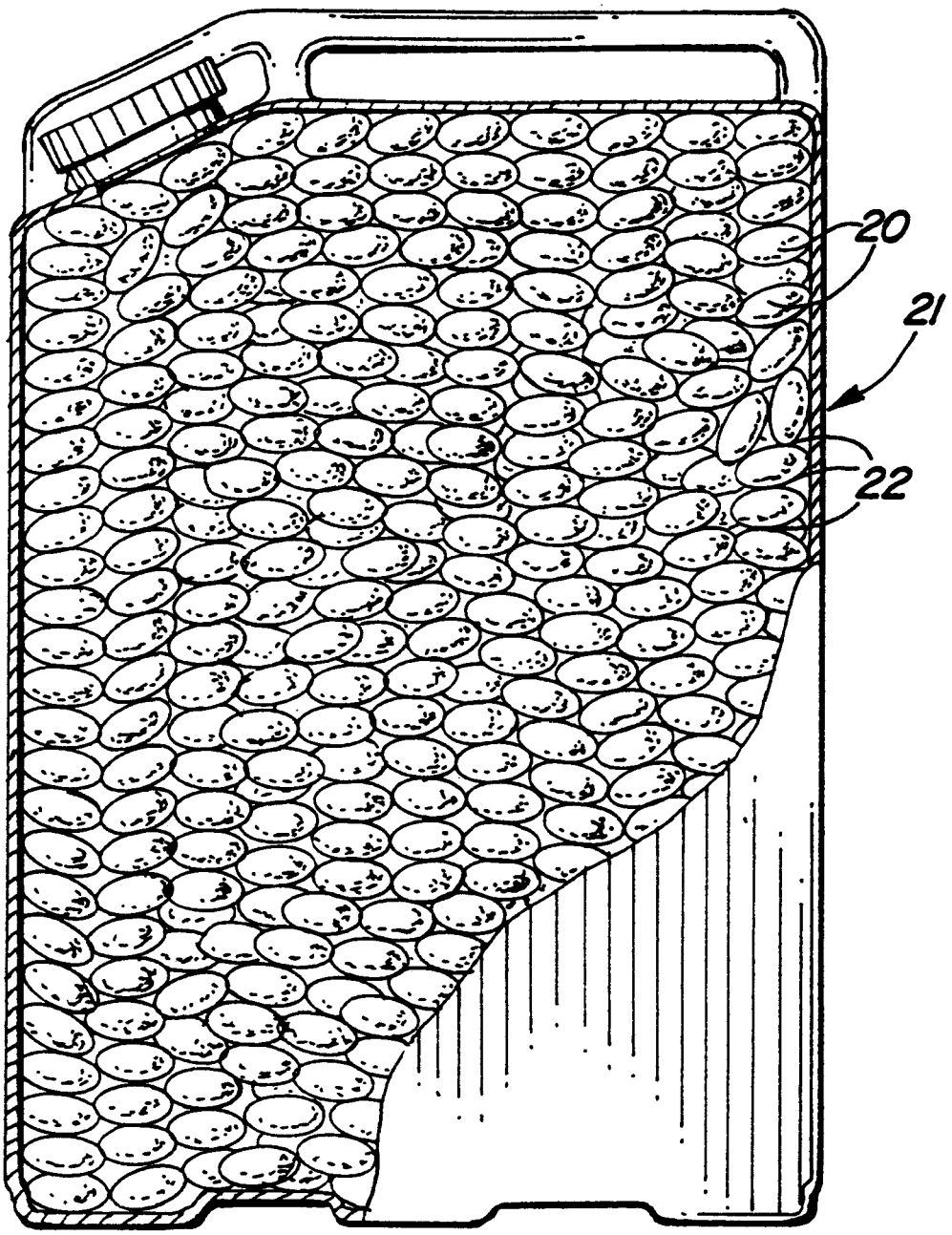
FIG. 6 is a cross-sectional view of an optional variation of the apparatus where ellipsoids without floating cores 20 are placed in a container of fuel 21. Their ellipsoid shape causes them to nestle closely together 22.

In another embodiment of the invention, the expanded metal net of the invention is cut into small segments which are then formed into small ellipsoid shapes which in themselves are useful in extinguishing or preventing fires or explosions, or may be used in combination with larger sheets of the expanded metal net for such purposes. The ellipsoids generally have a short diameter in the range of 15 to 55 mm, and a long diameter in the range of 25 to 75 mm, with the distance between focal points measuring approximately two-thirds of the long diameter of the ellipsoid. In the preferred embodiment, the ellipsoids have a specific internal surface area in the range from about 250 to about 325 $ft^2$ per $ft^3$, with particular usefulness in the range from about 300 to 325 $ft^2$ per $ft^3$. FIG. 6 shows this preferred embodiment where the article is comprised of nestled ellipsoids with a specific internal surface area in the range from about 250 to about 325 $ft^2$ per $ft^3$. The ellipsoids also are characterized as exhibiting and maintaining a porosity in the range of about 80 to 99%.

For certain purposes, it is desired to include in the ellipsoid a floatable core made of hollow balls or other floatable, non-flammable material. FIG. 4 shows the ellipsoid made from the expanded metal net of the present invention. In the embodiment shown, the ellipsoid 18 carries a floatable core 19 on its interior. FIG. 5 shows one form of a floatable ball useful as the core 19. The apparatus and method for producing these ellipsoids are described in detail in U.S. Pat. No. 5,207,756 and U.S. Pat. No. 5,297,416.

The ellipsoids of the present invention have a number of uses. Thus, in their floatable form, they may be distributed on the surface of flammable or explosive liquids, such as in fuel tanks, and in such configuration they provide a substantially improved anti-explosive or fire extinguishing function. Their ellipsoid shape causes them to nestle closely together, so that complete surface coverage is obtained, with no gaps through which flame from the liquid can upwardly escape.

In another application, the ellipsoids (without floating cores) may be used for filling of containers of fuel, for the purpose of preventing the explosion of such materials. This application is shown in FIG. 6. In this respect, they are superior to prior art spheres which, because of their spherical shape, could not nestle together and therefore had gaps between them through which flame could escape. If containers, large or small, are completely filled with the ellipsoids, a large amount of fuel can still be added to the container, to occupy the interstices in the metal nets from which the ellipsoids are made; and in such an arrangement the container is rendered explosion-proof for all practical purposes. With such an arrangement, if a spark occurs anywhere on the interior of the tank, the ellipsoid material immediately dissipates the heat of such spark and thus prevents detonation. To explain with more particularity, it is known that, in order for an explosion to occur, it is necessary that three elements must be present—namely, pressure, proper mixture of fuel vapor and oxygen, and ignition. In many fuel tanks, particularly those which are only partially full, the mixture of fuel vapor and oxygen, and the potential for pressure, are normally present, and therefore an accidental spark, or even the overheating of the walls of the tank, may supply the ignition which sets off an explosion. However, when the tank is filled with the metal net ellipsoids of the present invention, the possibility of ignition is eliminated because the metal net, because of its high electrical conductivity (volume resistivity of <50 ohm-m), immediately conducts the heat of the spark away from the fuel vapor/oxygen mixture.

The very small size of the ellipsoids of the present invention, and their special ellipsoid shape, make them uniquely useful for filling tanks, especially those having small inlet openings. Comparable anti-explosive results may be achieved if the tank is filled with the expanded metal net of the present invention, in sheet form rather than ellipsoid, but usually such application requires installation of the sheets during construction of the tank. In either case, it is important that the ratio of the volume of the metal net (ellipsoid or sheet) to the volume of the tank be kept within certain ranges. Generally, if too little metal net is used, the anti-explosive function will not be achieved, whereas if the metal net is filled in the tank too densely, the amount of remaining space for the fuel will be unduly limited. It is a feature of the invention that the tank be completely filled with the expanded metal net material but at the same time the volume of the actual metal itself must be in the range of about 0.4 to 1.1% of the volume of the tank. That is, when the tank is filled with the expanded metal net, the tank still will have a remaining capacity of 98.9 to 99.6% for fuel.

Although this "passive inerting" of fuel tanks has been tested with other materials, such as reticulated plastic foam or aluminum net balls or batts, the ellipsoids of the present invention, because of their high specific internal area and porosity and because of their ellipsoid shape, provide an exceptionally effective fuel tank filler, which excels in terms of properties such as flame arresting, electrical conductivity, hydrolytic and thermal stability, protection against hydraulic ramming, the reduction of over-pressure, protection against corrosion and contamination, and resistance to compacting.

In another application, the ellipsoids with cores are a useful adjunct for use in combination with large sheets of the expanded metal net of the present invention in extinguishing fires on the surface of water. Thus, if the expanded metal net alone is laid on the surface of such a fire, its tendency would be to sink below the surface and thus lose its effectiveness. However, if prior to laying down the net, sufficient numbers of the floatable ellipsoids are spread at intervals on the surface, and the expanded net is then spread over the fire, the ellipsoids will assist in keeping the expanded net afloat in the position where it will be most effective in fighting the fire.

The ellipsoids without floatable cores can also be used to extinguish land surface fires by covering the fire with large numbers of the ellipsoids. This may be accomplished by dropping burlap bags containing the ellipsoids into the surface fire and allowing the bags to burn and thus release the ellipsoids. The advantage of the ellipsoids in this configuration is that, by nestling together because of their shape, they tend to stay in one place rather than rolling downhill or across flat surfaces, as is the case with spheres.

Finally, when the slit pattern of the expanded sheet is controlled, as previously described, to produce expanded nets with high specific internal surface area and high porosity, ellipsoids made from such expanded nets are found to be surprisingly effective in fire-safety applications, such as fuel tank inerting fillers, flame arresters, anti-explosion barriers, mechanical impact shields, laser beam scrambling shields, oil well flame and detonation arresters, and the like. The body of expanded metal net, in spite of its lightweight and seemingly fragile structure, provides surprisingly effective protection against explosion damage, such as from bombs, TNT, and the like. Thus for example, a barrier mat consisting of layers of the ellipsoids of the present invention provides a non-reinforced wall of 6-inch concrete block with the same protection against explosion as provided by steel reinforcement, and, further, such a mat is capable of protecting a concrete block wall from the explosion of 200 pounds of TNT at 100 feet.

Other Uses for the Product of the Present Invention

By substituting other materials for the metal foil in producing an expandable product, it is possible to use the product in a number of different industries or applications, such as the packaging, insulation, or construction industries or as decorative items.

For example, if cardboard or strong kraft paper is used as the material, and if the placement of the knives on the slitting machine is adjusted for wider spaces between lines of slits, an improved packing or insulation material can be made for use in place of materials such as corrugated cardboard or air bubble insulation. The difficulty with present insulation materials is that they must be manufactured in finished form at the insulation plant and then transported in their bulky finished form to the different sites where they will be used. By use of the present invention, however, slitted cardboard or plastic sheets can be produced at the manufacturing site and then, prior to stretching into the net form, they can be transported in their compact, unstretched form to the place of use, where they can be stretched into final net or honeycomb form for use in producing boxes, spacers or other insulating items similar to the corrugated cardboard presently used. Thus, transportation and storage of large bulky items can be avoided.

In the roofing industry, the product of the present invention can be used as an improved replacement for the layers of tar-saturated cardboard covered with sand presently used for protecting and insulating roofs against water and heat or cold. The current procedure being used in the industry involves laying down a layer of tar saturated cardboard and then covering with a layer of sand, then another layer of tar or pitch, and a further layer of sand, and so on until the desired thickness for insulation has been accomplished. In the practice of the present invention, a single effective layer can be produced by adding an intermediate stage to the operation of the slitting machine. Thus, cardboard is used as the sheet material being fed to the machine, and the pulling speed of the takeoff device is adjusted to stretch the slitted sheet as it issues from between the slitting rollers. At this stage, before the sheet is removed from the machine, it passes over a work station where a mixture of melted tar and sand is distributed in the cells or eyes of the expanded net and a final layer of thin sand particles is distributed on the surface prior to hardening. The product is then hardened by a blast of cold air and then collected in rolls or sheets on the takeoff device. The resulting product can be used as a single layer for the insulation of roofs, in place of the labor-consuming multiple layers currently used. In another embodiment, rolls of slitted cardboard in unstretched, compact form can be transported to the construction site, where the material can be stretched into expanded net form, laid in place, and filled with tar and sand in situ.

In the construction industry, the metal nets of the present invention may be used to produce improved construction materials such as briquettes, tiles, wall board, ceiling tiles, and the like. For example, if the metal net is made from thin, strong, elastic material such as the aluminum or magnesium alloys described hereinbefore, it can be used as a reinforcing web on the interior of bricks to keep pieces from falling away if for any reason the brick is broken. Even further, by designing the thickness of the metal net to varying dimension, the net can be used as the interior structure for the other construction materials mentioned above. For example, a tile can be made by first producing an expanded metal net having the general thickness and shape of the tile to be made, filling the cells or eyes of the net with the clay, perlite, or other tile forming material, finishing the surfaces and edges, and then curing to complete the product. The same procedure can be used for wall boards and even thicker products such as construction briquettes made of perlite. Keeping in mind that the thickness and other dimensions of the expanded metal net can be controlled not only by adjusting the distance between lines of slits but also the extent to which the metal is stretched when it is pulled, the construction materials such as tiles, wallboards, bricks, etc. can be made in any desired shape or dimension. A special feature of construction materials produced in this manner is that the presence of the non-flammable metal net on the interior of the product prevents the spread of fires by keeping fire from passing through the net, as described in greater detail hereinbefore. Thus the construction materials of the present invention are improved not only from the standpoint of strength and elasticity, but also provide a previously unavailable feature—namely, fireproofing.

In the field of decorative arts, the metal nets of the present invention provide a number of useful innovations. Thus, when magnesium alloys are used as the raw material, and especially when combined with alkaline bichromate, the resulting net is an active, conductive, anticorrosive, rust-repellant, bright, easy to process, and formable material. For example, because it is bright, polychrome and stainless, the expanded net can be used as a flame-retaining decorative screen in front of fireplaces and stoves, as well as a decoration for windows. As a further example, if colored foils 0.03–0.08 mm thick are slitted and opened slightly to make matlike nets, they can be covered with single or double coats of facing materials and shaped as bracelets to be worn on the human body as jewelry to reduce static electricity.

Although preferred embodiments of the invention have been described herein in detail, it will be understood by those skilled in the art that variations may be made thereto without departing from the spirit of the invention.

What is claimed is:

1. An article having a specific internal surface area of at least about 250 $ft^2$ per $ft^3$ and a porosity of at least 80% and possessing effective flame arresting, explosion suppression and mechanical impact protection properties, comprising a body of multiple components of expanded net formed by longitudinally stretching slitted sheets of material, said material characterized in having a thickness in the range of 0.020 to 0.1 mm and having discontinuous slits in parallel lines which are spaced apart from 2 to 5 mm, the length of said slits being in the range between 0.8 and 2.5 cm, and the length of the gaps between slits being in the range between 1 to 6 mm.

2. An article as in claim 1 wherein the specific internal surface area is about 300 to 325 $ft^2$ per $ft^3$.

3. An article as in claim 1 wherein the porosity of said article is in the range of from about 80 to 99%.

4. An article as in claim 1 wherein said sheets of material are a metal foil.

5. An article as in claim 4 wherein said metal is aluminum or aluminum alloy.

6. An article as in claim 4 wherein said metal is a magnesium alloy.

7. An article as in claim 4 wherein said metal is steel.

8. An article as in claim 4 wherein said metal is copper or a copper alloy.

9. An article as in claim 4 wherein said metal is an alloy containing from 0.01 to 0.03 carbon.

10. An article as in claim 4 wherein said metal foil is an alloy of a metal selected from the group consisting of aluminum, magnesium, steel, copper, manganese, zinc, and chrome and contains from 0.01 to 0.03 carbon.

* * * * *